US005180204A

United States Patent [19]

Shirasawa et al.

[11] Patent Number: 5,180,204

[45] Date of Patent: Jan. 19, 1993

[54] HIGH STRENGTH STEEL PIPE FOR REINFORCING DOOR OF CAR

[75] Inventors: Hidenori Shirasawa, Hyogo; Yoshiki Tanaka, Akashi; Shinji Sawaki, Nagoya, all of Japan

[73] Assignees: Kabushiki Kaisha Kobe Seiko Sho, Kobe; Sango Co., Nagoya, both of Japan

[21] Appl. No.: 761,373

[22] Filed: Sep. 18, 1991

[30] Foreign Application Priority Data

Sep. 20, 1990 [JP] Japan ..... 2-253386

[51] Int. Cl.[5] ..... C22C 38/00

[52] U.S. Cl. ..... 296/146 C; 296/188; 49/502; 148/320; 148/909; 138/171

[58] Field of Search ..... 296/188, 148, 146 C; 49/502; 148/909, 320, 12 B; 308/171

[56] References Cited

U.S. PATENT DOCUMENTS 2,770,563 11/1956 Herzog ..... 148/909

4,204,892 5/1980 Economopoulos ..... 148/909

FOREIGN PATENT DOCUMENTS 56-23249 3/1981 Japan ..... 148/320

*Primary Examiner*—Deborah Yee

*Attorney, Agent, or Firm*—Oblon, Spivak, McClelland, Maier & Neustadt

[57] ABSTRACT

Herein described is a high strength steel pipe for reinforcing doors of a car, comprising a steel pipe made by seam-welding a steel sheet, wherein a ratio ($Hv_1/Hv_2$) of a minimum hardness in a softened area of a weld affected zone to an average hardness in a base material satisfies the following formula, $$-0.001\sigma B+1.05 \geqq Hv_1/Hv_2 \geqq -0.003\sigma B+1.05$$

wherein $\sigma B$: tensile strength (kgf/mm$^2$) and $Hv_1$, $Hv_2$: Vickers hardness and a ratio ($\sigma y/\sigma B$) of a yield strength $\sigma y$ to a tensile strength $\sigma B$ of a steel pipe is 0.7 or more.

6 Claims, 4 Drawing Sheets

HIGH STRENGTH STEEL PIPE FOR REINFORCING DOOR OF CAR

BACKGROUND OF THE INVENTION

1. Field of the Invention

The present invention relates to a member for reinforcing doors of a car and particularly, to a high strength steel pipe having a tensile strength of 100 kgf/mm$^2$ or more, preferably 120 kgf/mm$^2$ or more and having an excellent impact energy, which is made by welding a steel sheet comprising a single or composite phase of low temperature transformation products such as martensite, bainite or the like and a mixed phase of the above low temperature transformation products and ferrite.

2. Prior Art of the Invention

There has been promoted the attempt to strengthen and lighten a car reinforcing member, in order to reduce fuel consumption in a car body and enhance safety thereof in crashing. In particular, as a door reinforcing member, a 100 kgf/mm$^2$ grade pressed products has been mainly used. However, in recent years, as described in CAMP-ISIJ Vol.2 (1989)-2023, a pipe material having a higher strength has been used because of being advantageous in lightening.

The above pipe material needs to have high tensile strength of approximately 150 kgf/mm$^2$ for obtaining the absorbed energy similar to that of the pressed product.

Previously, the above-mentioned high strength pipe material has been manufactured in such a process that a thin steel sheet having a tensile strength of approximately 60 kgf/mm$^2$ is made into a steel pipe by seam welding, being heated with a high frequency heater, and is rapid-cooled by water cooling from an austenite temperature range. However, the steel pipe welded by seam welding or the like has a bonded interface, in which a so-called white band, that is, a decarbonized layer is generated as shown in FIG. 1. The white band is a portion molten by welding and includes oxide, inclusion and the like, thereby essentially being inferior in workability. Furthermore, since the white band is still difficult to increase in hardness by a quench process for enhancing the strength of the steel pipe, there is generated a softened area in a heat affected zone as shown in FIG. 2. Accordingly, in carrying out a bending test (crash test) as shown in FIG. 3, deformation is concentrated at the white band, and therefore there is generated cracks at the white band, that is, at a weld zone prior to buckling of the steel pipe so that the desired absorbed energy can not be obtained as a pipe A in FIG. 4. The behavior becomes significant in a test at a low temperature.

If an iron alloy including a carbon content lower than that at an eutectic point is used as a raw material for a seam-welded pipe, it is impossible to prevent generation of the white band in the weld zone. Also, when an upset amount on seam welding is increased to narrow the width of the white band, there occurs welding failure such as cold junction, thereby lowering a strength of a weld zone.

Further, when a steel pipe having the white band is heated in an austenite range and quenched by water cooling or the like, hardness of the white band is lowered than that of the base material as described above. Accordingly, deformation is concentrated at the white band on crashing, which causes cracks and therefore the desired absorbed energy can not be obtained. Meanwhile, as welded, the hardness of the weld zone is high and ductility is low so that in the case that distortion is increased on crashing, there occurs rapture at the weld zone in the direction right to a weld beam or at the white band, resulting in the lowered absorbed energy.

There has been unknown any method for improving workability of a seam-welded steel pipe at the weld zone thereof. However, with respect to a rim material for a wheel using a flash butt welding method similar to the seam welding method, it has been proposed to reduce the difference in hardness between the base material and the weld zone by using a base material having a structure composed mainly of bainite, as disclosed in Japanese Patent Laid-Open No. sho 57-35663.

It is assumed that, if a door reinforcing pipe material has the hardness distribution similar to that of the above rim material, cracks are prevented and therefore the desired absorbed energy can be obtained. However, the above proposal is made for a 60 kgf/mm$^2$ grade steel sheet having a low carbon content and the seam welding method is different from the flash butt welding method in the welding speed and cooling rate, so that it is difficult to obtain the hardness distribution similar to that of the flash butt welding in the high strength seam-welded steel pipe having a tensile strength of 100 kgf/mm$^2$ or more including a large amount of quenching elements such as C and Mn. Further, the above proposal discloses the existence of a softened area in the weld heat affected zone of a comparison material, that is, a composite structure steel plate, but it is not clear whether the hardness distribution similar to that of the flash butt welding can be obtained in a steel pipe having a tensile strength of 100 kgf/mm$^2$ or more including a large amount of quenching elements, which is made by a seam welding process at high welding speed. Further, the effect of the hardness distribution on the crashing of the pipe is also unknown.

SUMMARY OF THE INVENTION

It is therefore an object to solve the above-mentioned drawback and provide a high strength steel pipe for reinforcing doors of a car, which has high absorbed energy efficient to prevent rapture at the weld zone in crashing.

The inventors have investigated the quality of a weld zone of a steel pipe made by seam-welding a steel sheet, and thus accomplished the present invention.

Specifically, in the present invention, it is an object to provide a high strength steel pipe for reinforcing doors of a car, which is made by seam-welding a steel sheet, characterized by that a ratio ($Hv_1/Hv_2$) of a minimum hardness of a softened area in a weld affected zone to an average hardness in a base material satisfies the following formula, $$-0.001\sigma B+1.05 \geqq Hv_1/Hv_2 \geqq -0.003\sigma B+1.05$$

wherein $\sigma B$: tensile strength (kgf/mm$^2$) and $Hv_1$, $Hv_2$: Vickers hardness and a ratio ($\sigma y/\sigma B$) of a yield strength $\sigma y$ to a tensile strength $\sigma B$ of the steel pipe is 0.7 or more.

Hereinafter, the function of the present invention will be now described in detail.

In the present invention, the steel pipe is made by seam-welding a high strength thin sheet steel strengthened mainly by in the transformation structure thereof by a continuous annealing process after a hot-rolled or cold-rolled process, so that the hardness distribution of the weld zone and a yield ratio of the steel pipe are defined at the respective specified values, thus obtaining high absorbed energy.

That is, the weld heat affected zone has a softened zone having a suitable hardness, thereby reducing deformation in the weld zone.

Specifically, in the case that a ratio ($Hv_1/Hv_2$) of minimum hardness $Hv_1$ of a weld heat affected zone to a hardness $Hv_2$ of a base material exceeds the value of a formula ($-0.001\sigma B+1.05$) which is exhibited by a function of the tensile strength $\sigma B$ of the steel pipe, deformation in the heat affected zone is small on crashing so that deformation in the weld zone are increased. As a result, there occurs rapture at the white band in the weld zone and therefore, the desired absorbed energy can not obtained. In the case that the ratio ($Hv_1/Hv_2$) is less than the value of a formula ($-0.003\ \sigma B+1.05$), deformation in the heat affected zone is increased and the buckling is liable to generate easily on crashing and therefore, the desired absorbed energy can not be obtained. As described above, the hardness ratio ($Hv_1/Hv_2$) in the softened area in the heat affected zone is defined within a suitable range depending upon the tensile strength $\sigma B$ (refer to FIG. 5. In a steel pipe having comparatively low strength, approximately 100 kg/mm$^2$, the value of $Hv_1/Hv_2$ may be comparatively high, because the maximum hardness is not high so as to have a somewhat preferable workability. However, in a steel pipe having comparatively high tensile strength, approximately 200 kg/mm$^2$, it becomes important to increase deformation in the heat affected zone and if the value of $Hv_1/Hv_2$ is not comparatively lowered, it is impossible to prevent cracks on crashing and therefore high absorbed energy can not be obtained.

The minimum hardness $Hv_2$ at the softened area in the heat affected zone is defined at the suitable value, as described above. However, the broadness of the softened area is not defined and may be within the range obtained by an usual seam welding process. Further, the broadness of the softened area varies with the thickness of the steel pipe, and the structure and composition of the steel sheet as a raw material of the pipe and there occurs no problem if it is within the range obtained by the seam welding.

In the present invention, a steel pipe made by seam-welding the steel sheet having a specified strength is different from a steel pipe being subjected to heat treatment after pipe-making in that the weld zone is easily discriminated by a bead sensor. Accordingly, in assembling the steel pipe to a real car, the steel pipe is set in such a manner that the weld zone is located not directly before the loaded point but in the direction right to the loaded point, so that deformation of the weld zone is made smaller and therefore, the safety to the cracks can be furthermore enhanced.

In the present invention, it is required to define the yield ratio $\sigma y/\sigma B$ at 0.7 or more. The absorbed energy of the steel pipe on crashing is determined by the yield strength $\sigma y$, sheet thickness and pipe diameter. Accordingly, in order to aim at miniaturization, it is preferable to make the value of $\sigma y$ as high as possible. However, in the case of low yield ratio, the tensile strength becomes extremely high as the value of $\sigma y$ becomes high. Accordingly, it is required to increase the added amount of the reinforcing elements and the maximum hardness of the weld zone becomes higher, and therefore cracks is liable to generate. Furthermore, the high strength promotes wear of a pipe cutting tool. Therefore, it is important to define the yield ratio at 0.7 or more.

In order to increase the yield ratio, it is effective to provide the structure of a base material mainly including a low temperature transformation products, for example, single phase or composite phase of martensite, tempered martensite and bainite, and a mixed phase of the above composite phase and ferrite. The present invention, however, is not limited to the above structure.

In the present invention, the chemical composition and structure of the steel sheet as a raw material of a pipe is not limited utterly and either of hot-rolled steel sheet, cold-rolled steel sheet, and surface treated steel sheet such as a galvanized steel sheet may be used as the raw material. And, the steel pipe is made by seam welding with an usual pipe-making machine.

BRIEF DESCRIPTION OF THE INVENTION

DETAILED DESCRIPTION OF THE INVENTION

Hereinafter an exemplary embodiments according to this invention will be described.

EMBODIMENT 1

At first, a steel having a chemical composition adjusted to obtain a desired strength is hot-rolled, followed by being acid-pickled and cold-rolled, to be successively subjected to a continuous annealing process to form a tempered martensite structure for obtaining a high yield strength of 0.8 or more. The obtained steel sheet is seam-welded by an usual pipe-making machine, to obtain a pipe (pipe B: present example).

Meanwhile, for comparison, a pipe is made of a steel steel including a low carbon content by the above-mentioned process. The pipe is water-cooled from an austenite temperature range to enhance the strength. (pipe A: comparison example).

Figure 1:
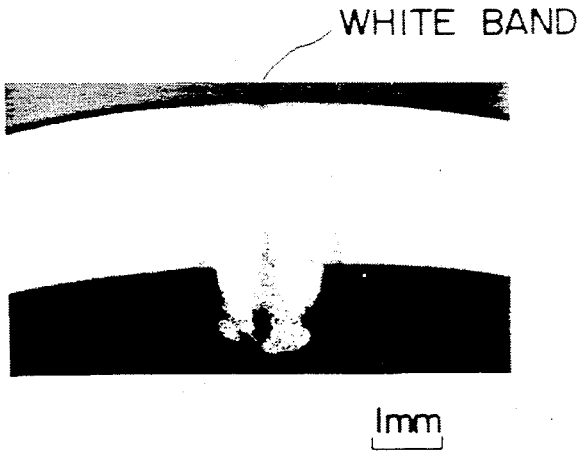
FIG. 1 is a photograph for showing a metal structure of a seam-weld zone.
Figure 2:
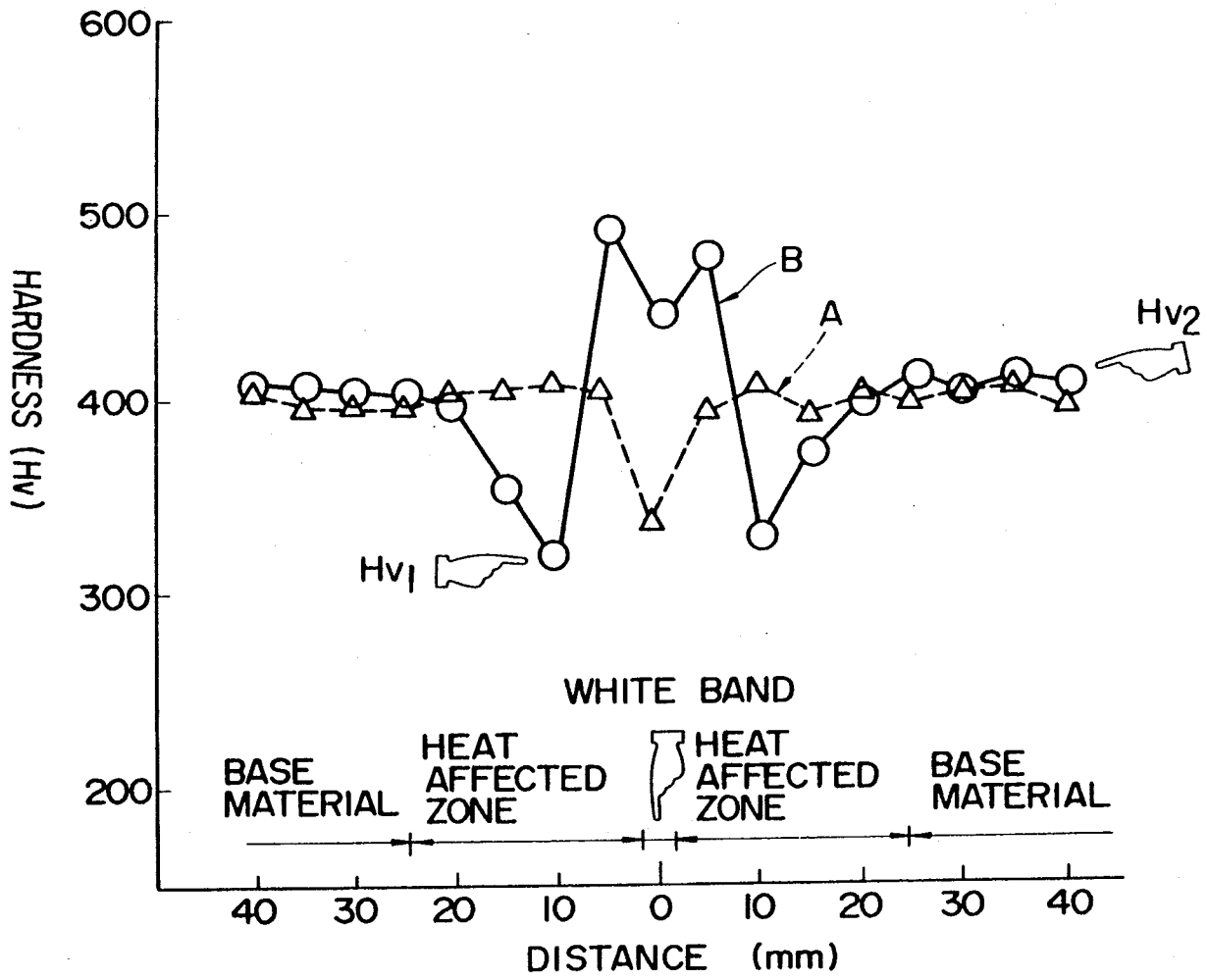
FIG. 2 is a view showing a hardness distribution of a seam-weld zone.
Figure 3:
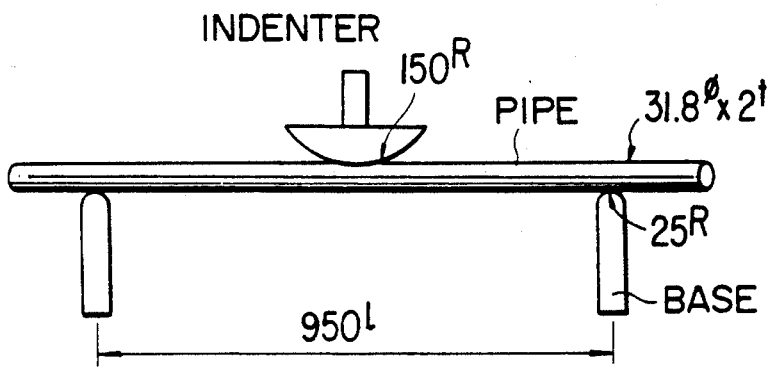
FIG. 3 is a view for explaining the procedure of a crash test for a pipe.
Figure 5:
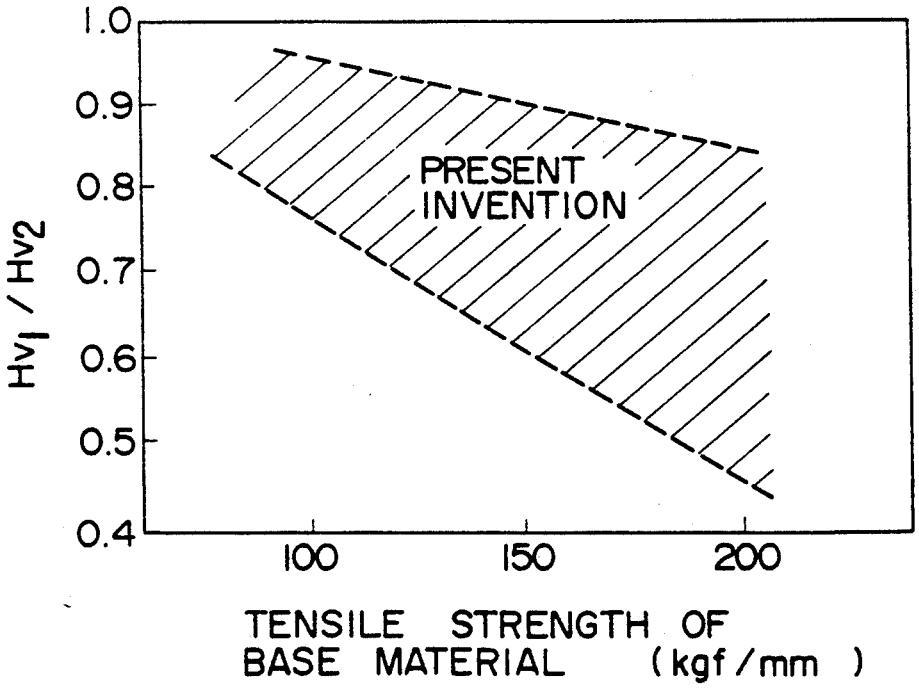
FIG. 5 is a view for showing a relationship between the ratio of minimum hardness $Hv_1$ to the hardness $Hv_2$ of a base material in a suitable heat affected zone and a pipe strength.
Figure 4:
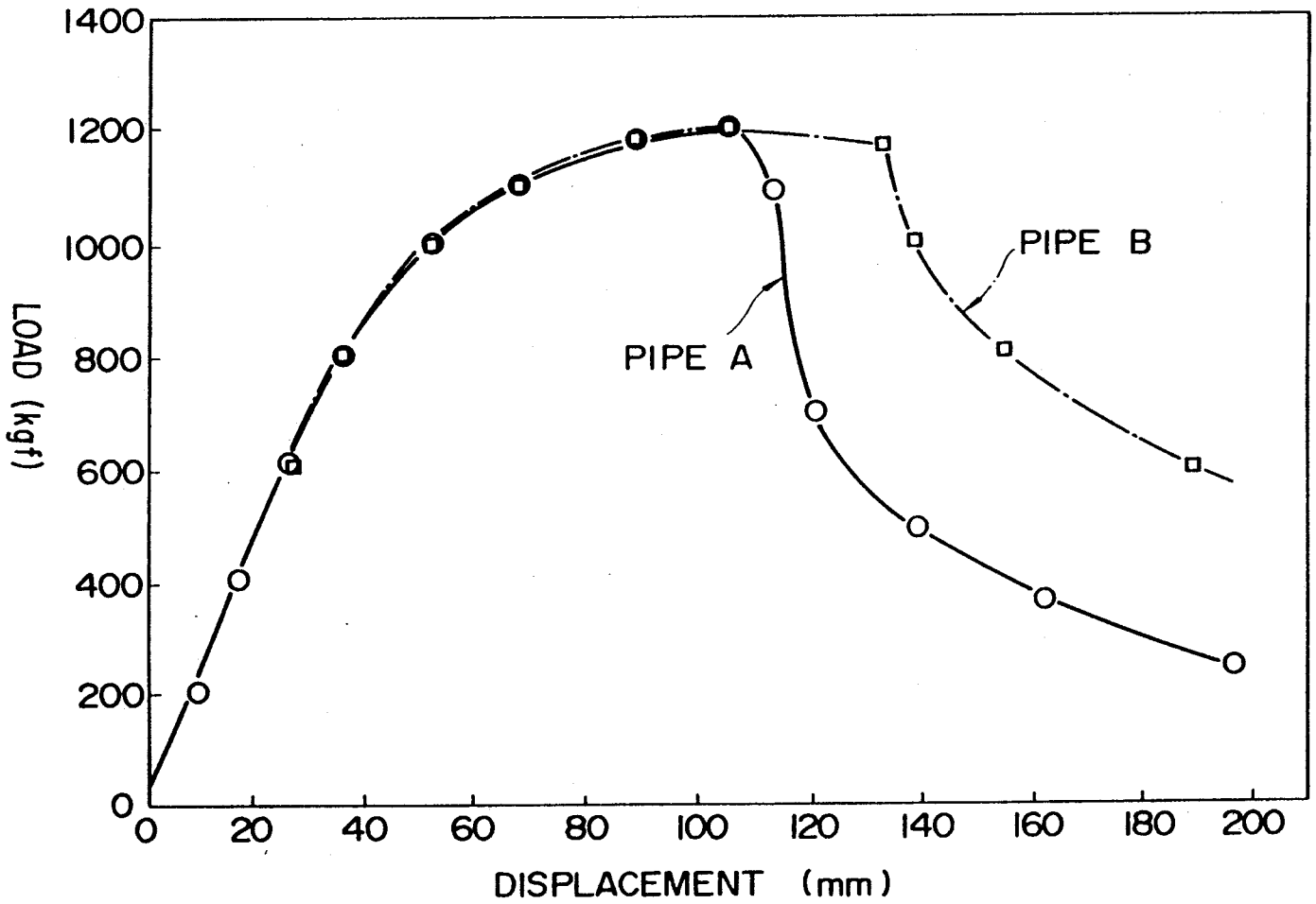
FIG. 4 is a view for showing a load-displacement curve in the crash test for a pipe.

FIG. 2 shows a hardness distribution of a weld zone in each pipe. FIG. 4 shows a load-displacement curve obtained by a crash test shown in FIG. 3, wherein an absorbed energy is calculated based on an area surrounded by the curve.

Either of the pipes has the approximately same hardness in base material, that is, the same strength. However, since the pipe B has a hardness ratio $Hv_1/Hv_2$ in the heat affected zone thereof within in a suitable range, as shown in FIG. 4, it is not cracked during the crash test as shown in FIG. 3 and is high in the absorbed energy as shown in FIG. 4. Meanwhile, in the pipe B, there occurs rapture at a white band during the crash test, resulting in the lowered absorbed energy as shown in FIG. 4.

EMBODIMENT 2

Steels, each having a different chemical composition, are hot-rolled and cold-rolled as conventional manner, followed by being subjected to a continuous annealing, to be quenched. Thus, steel sheets of 2.0 mm in thickness, each having a structure composed mainly of martensite, tempered martensite or bainite, are obtained for raw materials of pipes. In order to obtain another raw material, the above steel sheets are subjected to electric galvanization. Further, in order to the other raw material, the steel sheet after cold-rolled, having a structure composed mainly of bainite, is subjected to hot-dipping galvanization with a hot-dipping galvanizing line.

The respective steel sheets thus obtained are slitted, and are made into seam-welded pipes having 31.8 mm $\phi$ in diameter by a high frequency welding process.

As for each pipe, mechanical property, hardness and structure are investigated and also a crash test (span 950 mm) is carried out as shown in FIG. 3, to obtain an absorbed energy in indentation of 150 mm.

In the comparison examples No.1, since the strength is low, the desired absorbed energy can not be obtained.

In the comparison examples No.2 and No. 9 which are high in $Hv_1/Hv_2$ respectively, and in the comparison examples No.4 and No.7 which are low in $Hv_1/Hv_2$ respectively, there occur cracks in the crash test, so that the desired absorbed energy can not be obtained.

In the comparison examples No.11 and No.13, since the yield strengths of the pipes are low respectively, the desired absorbed energy can not be obtained.

Meanwhile, in the present examples, there occur no crack in the crash test and therefore the high absorbed energy can be obtained.

TABLE 1

| Test No. | Tensile strength (kgf/mm$^2$) | Elongation (%) | Yield ratio ($\sigma\gamma/\sigma\beta$) | Hardness ratio ($Hv_1/Hv_2$) | Suitable hardness ratio ($Hv_1/Hv_2$) | Absorbed energy (kgf-m) | structure | Remark |
|---|---|---|---|---|---|---|---|---|
| 1 | 75 | 25 | 0.80 | 0.87 | 0.98 to 0.83 | 96 | M | Comparison |
| 2 | 119 | 15 | 0.85 | 0.98 | 0.93 to 0.69 | 121 | Mt | Comparison |
| 3 | 135 | 13 | 0.90 | 0.85 | 0.92 to 0.65 | 160 | Mt | Present |
| 4 | 123 | 15 | 0.72 | 0.61 | 0.93 to 0.68 | 140 | F + B | Comparison |
| 5 | 128 | 12 | 0.92 | 0.81 | 0.92 to 0.69 | 161 | B | Present |
| 6 | 147 | 11 | 0.76 | 0.51 | 0.90 to 0.61 | 136 | F + M | Comparison |
| 7 | 161 | 8 | 0.71 | 0.54 | 0.89 to 0.57 | 121 | F + M | Comparison |
| 8 | 192 | 7 | 0.91 | 0.78 | 0.86 to 0.47 | 178 | Mt | Present |
| 9 | 190 | 6 | 0.98 | 0.92 | 0.86 to 0.47 | 139 | Mt | Comparison |
| 10 | 121 | 15 | 0.90 | 0.89 | 0.93 to 0.68 | 159 | B | Present |
| 11 | 158 | 12 | 0.65 | 0.80 | 0.89 to 0.57 | 121 | F + B | Comparison |
| 12 | 162 | 6 | 0.91 | 0.87 | 0.89 to 0.57 | 162 | B | Present |
| 13 | 120 | 16 | 0.61 | 0.85 | 0.93 to 0.68 | 114 | F + M | Comparison |
| 14 | 137 | 13 | 0.90 | 0.85 | 0.92 to 0.65 | 161 | Mt | Present |
| 15 | 128 | 12 | 0.92 | 0.82 | 0.92 to 0.69 | 160 | B | Present |
| 16 | 121 | 15 | 0.90 | 0.89 | 0.93 to 0.68 | 159 | B | Present |

(Note)
M: Martensite,
Mt: Tempered martensite,
B: Bainite,
F: Ferrite
No. 1 to 13: Cold-rolled steel sheet
No. 14: Electric galvanized steel sheet (duplicated galvanization, thickness: 7$\mu$)
No. 15: Hot-dipping galvanized steel sheet (duplicated galvanization, thickness: 9$\mu$)
No. 16: Alloyed hot-dipping galvanized steel sheet (duplicated galvanization, thickness: 7$\mu$)

What is claimed is:

1. A high strength steel pipe for reinforcing doors of a car, comprising a steel pipe made by seam-welding a steel sheet, wherein a ratio ($Hv_1/Hv_2$) of a minimum hardness in a softened area of a weld affected zone to an average hardness in a base material satisfies the following formula, $$-0.001\sigma B+1.05 \geqq Hv_1/Hv_2 \geqq -0.003\sigma B+1.05$$

wherein $\sigma B$: tensile strength (kgf/mm$^2$) and $Hv_1$, $H_2$: Vickers hardness and a ratio ($\sigma y/\sigma B$)of a yield strength $\sigma y$ to a tensile strength $\sigma B$ of a steel pipe is 0.7 or more.

2. A high strength steel pipe for reinforcing doors of a car defined in claim 1, said steel pipe comprising a single or composite phase of low temperature transformation products of martensite, tempered martensite, bainite and a composite phase of said low temperature transformation products and ferrite.

3. A high strength steel pipe for reinforcing doors of a car defined in claim 1, said steel pipe having a tensile strength of 120 kgf/mm$^2$ or more.

4. A high strength steel pipe for reinforcing doors of a car defined in claim 1, wherein a cold-rolled steel sheet is used as a raw material.

5. A high strength steel pipe for reinforcing doors of a car defined in claim 1, wherein a galvanized steel sheet is used as a raw material.

6. In a door of a car incorporated with a steel pipe as a reinforcing member inside a door main body, said steel pipe comprising a steel pipe made by seam-welding a steel sheet, wherein a ratio ($Hv_1/Hv_2$) of a minimum hardness $Hv_1$ in a softened area of a weld affected zone to an average hardness $Hv_2$ in a base material satisfies the following formula, $$-0.001\sigma B+1.05 \geqq Hv_1/H_2 \geqq -0.003\sigma B+1.05$$

wherein $\sigma B$: tensile strength (kgf/mm$^2$) and $Hv_1$, $Hv_2$: Vickers hardness and a ratio ($\sigma y/\sigma B$) of a yield strength $\sigma y$ to a tensile strength $\sigma B$ of a pipe is 0.7 or more.

* * * * *